US005276437A

United States Patent [19]

Horvath et al.

[11] Patent Number: 5,276,437

[45] Date of Patent: Jan. 4, 1994

[54] MULTI-MEDIA WINDOW MANAGER

[75] Inventors: Thomas A. Horvath, Stormville; Inching Chen, Wappingers Falls, both of N.Y.

[73] Assignee: International Business Machines Corporation, Armonk, N.Y.

[21] Appl. No.: 872,739

[22] Filed: Apr. 22, 1992

[51] Int. Cl.[5] ..... G09G 1/06

[52] U.S. Cl. ..... 345/119; 345/118

[58] Field of Search ..... 340/721, 723, 724, 747, 340/799, 798; 395/157, 155

[56] References Cited

U.S. PATENT DOCUMENTS

| | | | |
|---|---|---|---|
| 4,642,790 | 2/1987 | Minshull et al. | 340/724 |
| 4,670,752 | 6/1987 | Marcoux | 340/724 |
| 4,769,636 | 9/1988 | Iwami et al. | 340/724 |
| 4,769,762 | 9/1988 | Tsujido | 364/521 |
| 4,779,081 | 10/1988 | Nakayama et al. | 340/721 |
| 4,780,709 | 10/1988 | Randall | 340/721 |
| 4,783,648 | 11/1988 | Homma et al. | 340/724 |
| 4,790,025 | 12/1988 | Inoue et al. | 382/41 |
| 4,806,919 | 2/1989 | Nakayama et al. | 340/721 |
| 4,823,108 | 4/1989 | Pope | 340/721 |
| 4,860,218 | 8/1989 | Sleator | 364/518 |
| 4,954,819 | 9/1990 | Watkins | 340/721 |

*Primary Examiner*—Ulysses Weldon
*Assistant Examiner*—Doon Yue Chow
*Attorney, Agent, or Firm*—Sterne, Kessler, Goldstein & Fox

[57] ABSTRACT

An apparatus and method for displaying non-obscured pixels in a multiple-media motion video environment (dynamic image management) possessing overlaid windows. In an encoding process, only boundary values and identification values corresponding to each window on a screen are saved in memory of a hardware device. In a decoding process, the hardware device utilizes these initial boundary values saved in memory in such a way that when incoming video data enters the hardware device, the hardware device need only compare the incoming video data's identification with the identification saved in memory. The hardware device includes: compare logic devices, counters, minimal memory devices, a control logic block, and a driver.

13 Claims, 3 Drawing Sheets

MULTI-MEDIA WINDOW MANAGER

TECHNICAL FIELD

The present invention relates generally to an apparatus and method for managing multiple windows. More particularly, the present invention relates to an apparatus and method for displaying non-obscured pixels in a multiple-media motion video environment (dynamic image management) possessing overlaid windows.

BACKGROUND ART

Multi-media is the hottest topic in the computer industry today. It is widely proclaimed as the next revolution in computing. The reason multi-media is "hot," is the potential for humanizing information.

Multimedia implies the ability to integrate multiple forms of data in a computer environment. The various data forms include: audio, image, motion video, graphics, text and animation. Due to the volume and variety of data which must be managed within the internal structure of a computer and ultimately presented to the user, new methods for managing that data through the display interface need to be developed.

For instance, in the area of still image graphics, when windows are overlaid upon one another, a paramount consideration is that a higher level window take priority over a lower level window. In other words, a lower window's image should not show through to a higher window overlaid on top of the lower window. Normally, the windows have a display priority. The window with the highest priority is displayed on top of all other windows. As a result, some windows are obscured or partially obscured by other windows.

However, techniques used in still image graphics do not lend themselves to displaying multiple windows, overlaid upon one another, displaying dynamic images (motion video). Software techniques are too slow to meet the real-time requirements of motion video data. Typically, display of video data requires a processor capable of performing 120 million operations per second when displaying video images at a rate of 30 frames per second on a 1024 by 768 pixel screen.

Most software techniques, typically used for displaying static window images, are inadequate to decide on a pixel-by-pixel basis whether to display or discard a pixel in real-time. Thus, trying to decide whether to display a pixel or discard a pixel in an overlaid multi-media window environment with multiple media windows requires the need for real-time presentation.

Typically, hardware assistance such as a pixel map look-up table is employed to determine in real-time whether a given pixel is to be displayed or discarded in a multi-media, overlaid multi window environment. However, the costs involved are currently prohibitive due to the amount of storage space required. For instance, a 1000×1000 pixel screen requires the mapping of 2 million bits of pixel information. Additionally, a pixel map look-up table is limited to serve only a few windows, typically a maximum of 4 windows. The number of windows is limited by the amount of memory. Furthermore, the expense involved in order to display multiple windows displaying dynamic images, utilizing a pixel map look-up table is exorbitant due to memory restrictions.

Therefore, what is needed is a window manager device that uses significantly less storage space than a pixel map look-up table and is able to process multiple windows displaying motion video data in real time.

DISCLOSURE OF INVENTION

The present invention relates to an apparatus and method for displaying nonobscured pixels in a multiple motion video environment (dynamic image management) possessing overlaid windows. The present invention is implemented through dedicated hardware that decides on a pixel-by-pixel basis whether to display or discard a given pixel according to a display priority for each overlaid window.

The philosophy of the present invention is to take advantage of the sequentiality of motion video and to encode the necessary information that determines boundaries of windows, in such a way that this information can be decoded as video data as it is received from a raster scan video source.

The present invention is employed in a raster scan system video display system for displaying nonobscured pixels in a multiple media motion video environment possessing overlaid windows. According to one embodiment of the present invention operations can be broken down into an encoding process and a decoding process.

The encoding process includes encoding data detailing window location and size. Window edges are extended in vertical and horizontal directions corresponding to a horizontal and vertical coordinate system on the screen to form a multiple of clip rectangles. Ownership identifications (IDs) corresponding to a video source (i.e. A, B, and C) are assigned to each clip rectangle according to window priority and stored in a table of memory. Horizontal and vertical pixel values where the extended edges intersect the horizontal and vertical coordinate system are stored in memory. Each window is also identified by one clip rectangle coordinate value which is stored in a table of memory.

The decoding process of the system includes a first counter coupled to horizontal and vertical memory tables that count pixel coordinates starting from the minimum horizontal and vertical coordinate values. A second counter counts coordinate values of clip rectangles stored in memory. A compare logic device which is coupled to the first counter compares an output of the first counter with the horizontal and vertical boundary pixel values stored in memory. A second compare logic device is coupled to memory and compares ID values stored memory with an ID value received from a video source of the video environment. A control device is coupled to the second compare logic device and receives vertical and horizontal synchronization signals from the video sources. The control device also generates a data display enable signal when said stored ID value and said received ID value compared by the second compare logic device are the same. Finally a data display control driver is coupled to an output of the control device which passes data to a video display buffer upon receipt from the control device of the display enable signal.

FEATURES AND ADVANTAGES OF THE INVENTION

One feature of the present invention is to provide a technique for managing multiple motion video windows employing less memory space than present devices can provide.

Another feature of the present invention is simplicity. The present invention can be implemented with very simple hardware components making it far less expensive than present devices.

A further feature of the present invention is the ability to display several overlapped motion video windows as opposed to static windows. Thus, the present invention is able to function in real time.

Another feature of the present invention is its processing logic performance. The present invention utilizes comparison logic which requires significantly less processing logic than present implementations.

Further features and advantages of the present invention, as well as the structure and operation of various embodiments of the present invention, are described in detail below with reference to the accompanying drawings.

BRIEF DESCRIPTION OF THE DRAWINGS

The present invention will be described with reference to the accompanying drawings, wherein.

In the drawings, like reference numbers indicate identical or functionally similar elements. Additionally, the left-most digit of a reference number identifies the drawing in which the reference number first appears.

BEST MODE FOR CARRYING OUT THE INVENTION

I. Overview.

The present invention is directed to an apparatus and method for displaying nonobscured pixels in a multimedia motion video environment (dynamic image management) possessing overlaid windows. In an encoding process, boundary values and identification values corresponding to each window to be displayed on a screen is stored in memory of a hardware device. In a decoding process, the hardware device utilizes these initial boundary values saved in memory in such a way that when incoming video data enters the hardware device, the hardware device need only compare the incoming video data's identification with the identification saved in the hardware device. The aforementioned overview is described in the following sections.

II. Hardware Device.

Figure 1:
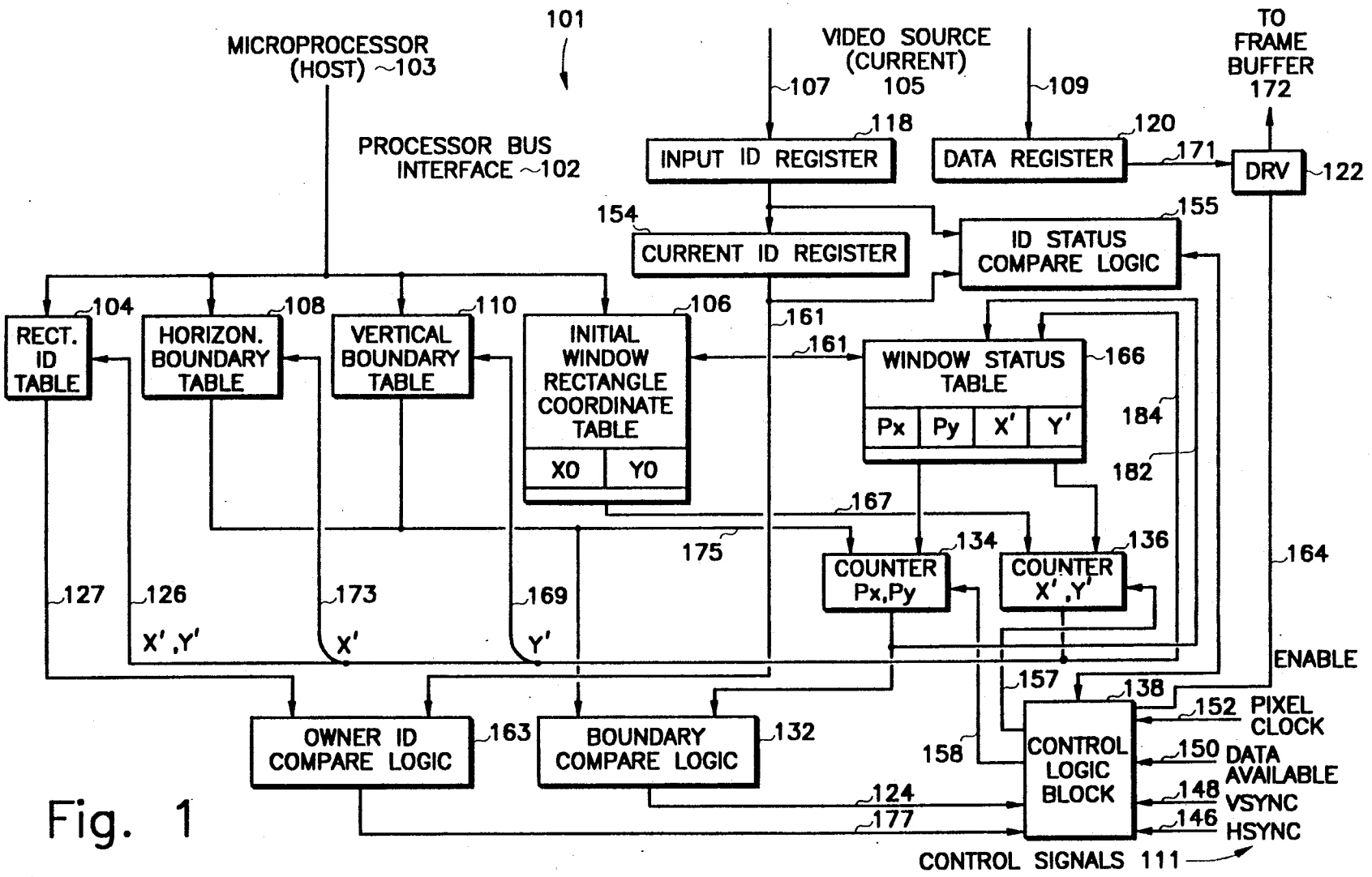
FIG. 1 illustrates a block diagram of a hardware device according to the present invention.

FIG. 1 illustrates a block diagram of a hardware device 101 according to a first embodiment of the present invention. Arrows between blocks show data flow. One skilled in the art should understand that data flow arrows may represent more than one data path or signal. The hardware device 101 includes the following data flow elements: a rectangle identification (ID) table 104, a horizontal boundary table 108, a vertical boundary table 110, an initial window rectangle coordinate table 106, a window status table 166, an input data register 120, a driver 122, an input identification ID register 118, a current ID register 154, counters 134, 136, comparator devices or compare logic blocks 132, 155, 163, and a control logic block 138 which regulates the flow of data. Control logic block 138 is a simple state machine implemented with programmable logic or ASICS. All elements of the hardware device 101, as will become apparent, are easily implemented and are well known to those skilled in the art.

FIG. 1 is a general high level representation of the present invention. Many control signals from the control logic block 138 are deliberately not drawn, because such detail would impede rather than aid in the understanding of this invention. Further details of the hardware device 101 including its operation will be described below.

Pixel counter 134 and pointer counter 136 represent four separate counters, Px, Py (where P stands for pixel), X' and Y' (pixel counter 134 comprises Px, Py and pointer counter 136 comprises X',Y'). For the purpose of graphical simplification, the four separate counters are represented as two counters in combination. In addition, control signals 157 and 158, which connect the control logic block 138 to counters, 134 and 136, are each represented as one data flow signal for simplification purposes. Control signal 157 includes four separate signals load (LD) X', LD Y', increment (INC) x and INC y. Likewise data flow signal 158 includes four separate signals LD Px, LD Py, INC Px and INC Py. No actuation signal is sent during a no operation (NOP) for either signal 157 or 158. In the preferred embodiment, all tables (rectangle ID table 104, horizontal boundary table 108, vertical boundary table 110, initial window rectangle coordinate table 106, and window status table 166) are implemented using random access memory (RAM) devices. However, in other embodiments, the memory devices employed may be any type of readable and writable memory. In addition, all the tables may be combined into one memory device unit (with separated tables of memory). To aid in understanding the operation of the present invention, the tables are depicted as separate blocks.

The hardware device 101 is interfaced to a microprocessor (host) 103 via a processor bus 102. The processor bus 102 may be any number of bits wide depending on a particular system (e.g. 8, 16, and 32 bits wide). The processor bus 102 acts as a means for transferring window region boundary parameters (to be described) to be written to the hardware device 101 for storage.

Hardware device 101 is also interfaced to video sources 105. Input ID register 118 receives a source data signal (ownership ID signal) 107 indicating which of the connected video sources 105 is sending data. This is indicated by an ownership ID originating at video source control logic (not shown) of video sources 105. Data register 120 receives display data 109 (digital pixels to be displayed) from video sources 105. Display data 109 received by data register 120 has associated with it the ownership ID signal 107 of a particular video source 105 sending display data.

Control signals 111 are connected to the control logic of the video source(s) 105. Video sources 105 may include digitized video cameras, laser disc players, VCRS, virtual reality simulators and other related devices used in graphics. Control signals 111 include: a horizontal synchronization signal (Hsync) 146, a vertical synchronization signal (Vsync) 148, a data available signal 150 and a pixel clock 152.

Hardware device 101 is further interfaced to a frame buffer 172 via driver 122. Driver 122 passes pixel data 171 from data register 120 to the frame buffer 172 when enabled via data flow arrow 164.

III. Operation.

Figure 2:
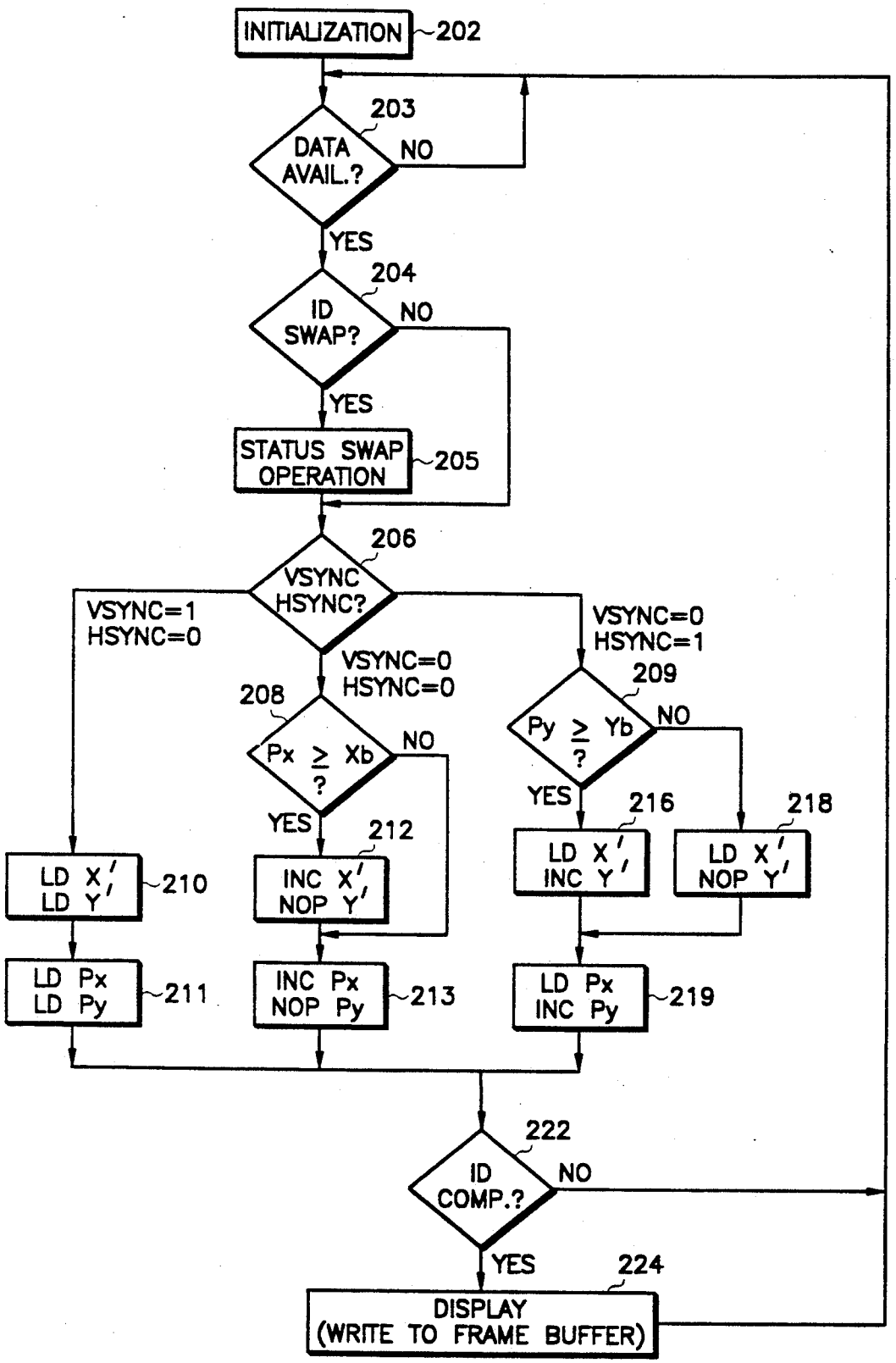
FIG. 2 illustrates a flow chart representing the operation of the hardware device according the present invention.

The operation of hardware device 101 is generally illustrated in the flow chart in FIG. 2. An overview of the chart will be described in the following section. A more detailed description will follow.

A. General Overview.

In a step 202, encoded data from host 103 is loaded into hardware device 101 via processor interface bus 102. The encoding method is described in a separate section below with reference to FIG. 3.

In a step 203, hardware device 101 waits for data available signal 150 to go active indicating that valid data is available.

In a step 204, hardware device 101 monitors which video source 105 is sending data. Each video source 105 is assigned a separate window to send data. If an incoming pixel is received from a different video source 105 than a previous pixel, then the hardware device performs a step 205. In step 205, the hardware device 101 performs a status swap by storing current values relating to a previous video source's 105 pixels and reads out stored values for the current video source's 105 pixels. The values read out are used to update counter 134, 136.

In a step 206, the hardware device 101 monitors Hsync 146 and Vsync 148 signals from video source control logic of a video source 105 indicating the start and end of a row for pixels being displayed in a window region. In other words, Hsync 146 and Vsync 148 signals are observed by control logic block 138 to determine if input data from the current video source 105 marks the beginning of a new line in the current frame, the beginning of a new video frame, or a continuation of the current line in a current video frame.

In steps 208 and 209, the hardware device 101 determines if the horizontal and vertical boundary limits, respectively, have been exceeded for a current operational region of windows on a screen. This is determined by comparing counted pixel values with boundary dividers of clip rectangles which were stored in memory during the encoding process of initialization step 202.

In steps 210–219, control logic block 138 sends control signals 157 and 158 to load, increment or leave unmodified the contents of counters 134 and 136.

In step 222, the ownership ID of a previously determined operational region is compared to the ID of the input pixel to determine if the pixel is to be displayed. If the stored ID and the incoming ID data do not match, then the driver 122 is not enabled.

In step 224, if the stored ID and the incoming ID match, the driver 122 is enabled and an input pixel is sent to the frame buffer to be stored and displayed.

The operation of the hardware device 101 will now be described in greater detail.

B. Initialization.

In step 202, the hardware device 102 is initialized with encoded data from a host 103 via the processor bus interface 102. The initiation process involves two steps: 1) an encoding method and 2) a loading and storing process. Step 1 involves deciding window locations on-line (before video sources 105 are activated) as a means for assigning window priority. Step 2 involves storing this information in the rectangle ID table 104, the horizontal boundary table 108, the vertical boundary table 110, and the initial window rectangle coordinate table 106.

1. Encoding.

Figure 3:
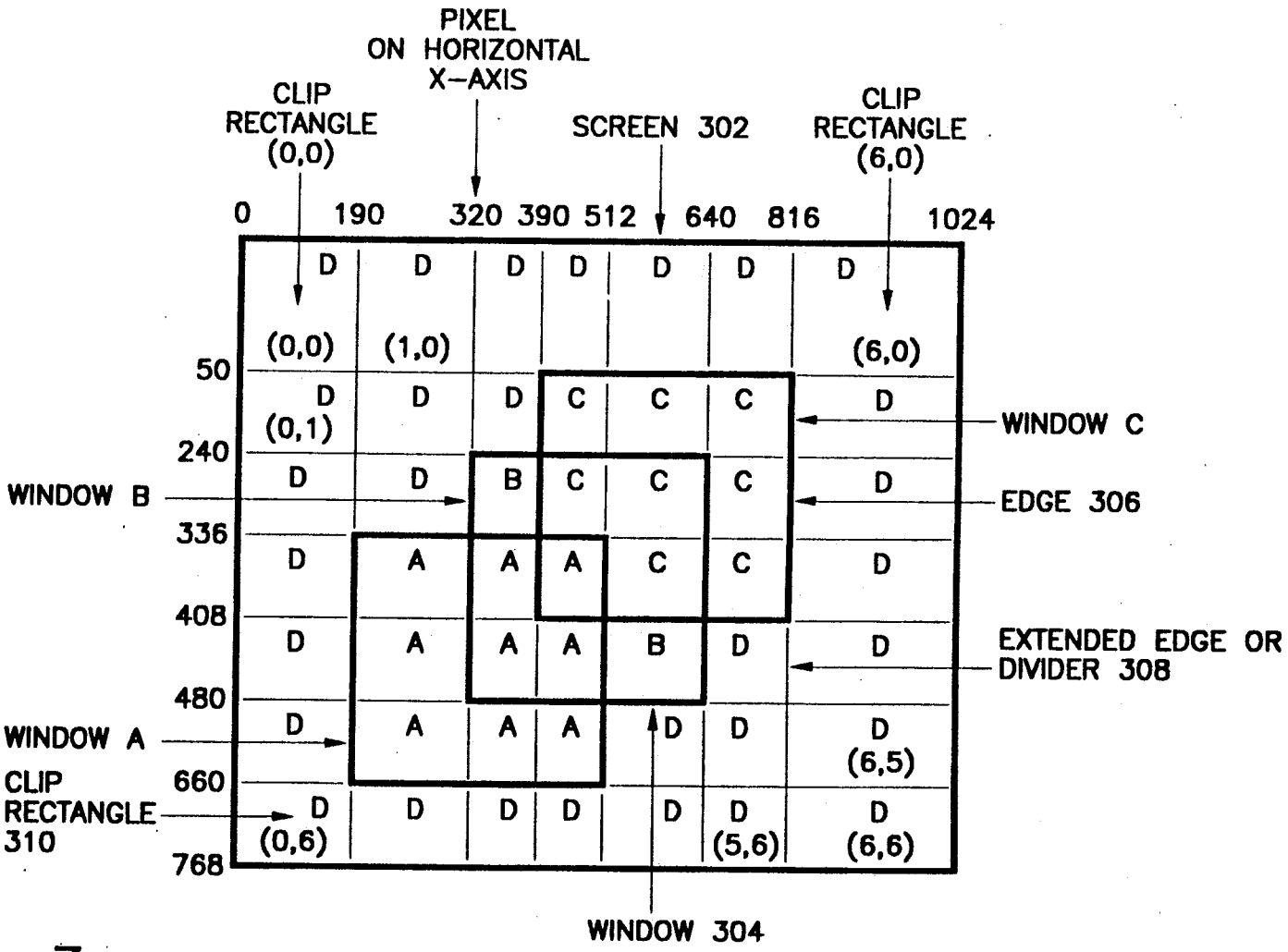
FIG. 3 illustrates an example of a screen with multiple windows implemented according to the present invention.

FIG. 3 illustrates an example of a screen 302 with multiple windows 304 implemented according to the present invention. Windows 304 (a window A, a window B, and a window C) display dynamic image data (motion video).

Location of the windows 304 are input by a user in a conventional fashion known to those skilled in the art familiar with window generation (location is usually indicated by a mouse). A microprocessor (host) 103 allows a user to select window 304 locations and sizes. An X axis and a Y axis illustrate horizontal rows and vertical columns of pixels on a screen 302. The X axis includes pixels 0 through 1024 and the Y axis includes pixels 0 through 768.

Once a user decides on a window location, the windows 304 act as an encoding means. For instance, instead of dividing the screen into fixed size blocks, the present invention uses the coordinates of each window by extending the edges 306 of created windows 304 in X and Y directions to create extended edges 308. The extended edges 308 are used as boundaries or dividers also 308. Dividers 308 form non-uniform regions (clip rectangle 310) of the screen 302. In other words, the encoding method of the present invention utilizes clip rectangles 310 which vary in size throughout the screen 302 depending on the number of windows 304 and the respective sizes of such windows 304. Whereas in conventional methods clip rectangles 310 were not dependent on widows 304. Clip rectangles 310 were typically a predetermined size and shape (like graph paper) irrespective of the number of windows and their sizes. According to the present invention, the number of clip rectangles 310 will always be determined by the number, location and size of windows being displayed.

Referring to the example illustrated in FIG. 3, three windows 304 divide the screen 302 into forty-nine clip rectangles 310. Each clip rectangle 310 is assigned an owner identification (ID) value or parameter according to priority. In this example, the priority of displaying windows 304 in an overlaid fashion are as follows: priority $=A>C>B>D$. The ID value D represents priority of clip rectangles which make up the background. Besides having an owner ID value, each clip rectangle 310 has a coordinate value (0,0), (5,6) and so forth.

The locations of windows 304 are defined by X and Y pixel coordinates. By extending all window boundaries or window edges 306 both horizontally and vertically and sorting them in an increasing order, (from left-to-right, top-to-bottom) the boundaries for all clip rectangles 310 are determined. These values are stored in the Horizontal and Vertical Boundary Tables 108 and 110 to be used for determining boundary crossing conditions to be described.

2. Loading and Storing Process.

Encoding the windows 304 by the method described above significantly reduces the amount of memory needed to track pixels on the screen 304. Only 4 parameters need to be loaded into the memory of the hardware device 101. The horizontal and vertical boundary values which are defined by the clip rectangles 310 are loaded into the horizontal boundary 108 and vertical boundary 110 tables respectively. For example, the horizontal boundary or divider 308 for clip rectangle (3,1) is 512 and the vertical divider is 240. The corresponding ownership ID ( A, B, C or D) value for each clip rectangle 310 is loaded into the rectangle ID table 104. These IDs indicate which video source takes priority over that region. If multiple sources claim a particular clip rectangle 310, prioritization must occur to determine the source priority order. A higher priority source takes precedent over a lower priority source when accessing a clip rectangle 310.

The coordinate value (XO 114 and YO 116) for the initial clip rectangle of each window is loaded into the initial window rectangle coordinate table 106. The parameter (XO,YO) represents a left most and top most clip rectangle 310 coordinate value of a particular window 304. Referring to FIG. 3, the (XO,YO) parameters for window C is (3,1) for window B is (2,2) and for window A is (1,3). Thus, the number of ID parameters (XO,YO) will equal the number of windows to be displayed (which is 3 windows in this example).

Once this encoding process is completed, the operation of hardware device 101 can start.

C. Data Available.

Step 204 represents what happens when data enters the hardware device 101 from the video source 105. There are two types of data that come from the video source: display data 109 and ID data 107. Display data 109 represents what is going to be displayed. ID data 107 corresponds to the particular video source 105 displaying display data 109 (in this example a video source A, a video source B or a video source C).

In step 204, display data 109 from a video source 105 enters data register 120. At the same time, ID data 107 corresponding to the display data 109 enters the input ID register 118. Before acting on this data, hardware device 101 waits for data available signal 150. In particular, the control logic block 138 waits for the data available signal 150 to go active. An active data available signal indicates that valid data is coming from the video source 105. Once the data available signal 150 goes active, data 107 and 109 from the video source 105 are acted upon.

D. Changes in Video Sources.

Data 107 and 109 can arbitrarily come in from any video source 105 (A, B or C) at any one time. A change of incoming data can occur quite frequently. Therefore, it is necessary to keep track of which video source 105 (A, B or C) is sending data and to retain separate status information (to be described below) on the window parameters of each of the input video sources 105.

To reduce the overhead of expensive hardware and to keep track of all values in all possible video windows supported by the system 101, a mechanism is implemented whereby the currently active window parameters from 104–110 are kept in active counters 134 and 136. Parameters associated with inactive windows are stored in the window status table 166 which can be implemented by less expensive memory hardware. If the incoming data source ownership ID signal 107 for the current display data 109 is different from the previous data source ID signal 107, then a swap of the active and inactive window status parameters is required. This involves the storing of the latest values associated with the new data source ID signal 107 into the active counters 134 and 136.

1. Current Video Source.

The current ID register 154 contains the video source signal 107 ID for the latest data which was processed by the hardware device 101. At the same time data is placed into the data register 120, the input ID register 118 also receives the value of the ID associated with the input data. In step 204, the value in the input ID register 118 is compared with the ID value stored in the current ID register 154. The comparison is performed by a comparator device or compare logic block 155. If they are equal then no action need be taken in updating the values in the active counters since they should already contain the necessary information needed to process the incoming data. In this case, the sequence proceeds to step 206 to determine the Hsync and Vsync status as will be described below.

2. Data Swap.

If in step 204 the contents of the input ID register 118 do not compare with the contents of the current ID register 154, a status swap operation must take place in step 205. Step 205 consists of a sequence of multiple operations. First the current Px, Py values in counter 134, via data flow arrow 182, and X',Y' values in counter 136, via data flow arrow 184, are stored in the window status table 166. These values are stored using the current ID register 154 value signal 161 as a pointer. Then the current ID register 154 is loaded with the value contained in the input ID register 118 to reflect the ID associated with the incoming pixel data. Using the updated current ID register 154 value signal 161 again as a pointer, counters 134 and 136 are then loaded with the Px,Py and X',Y' values associated with the new window parameters stored in window status table 166.

There are several ways to implement the above-described sequence which would result in one, two or three operations. By using dual-ported memory hardware the read and write operations can be accomplished in one machine cycle thereby reducing the sequence from three steps to two steps. By overlapping the loading of the current ID register 154 with the read and write operations the sequence can be further reduced to one step.

It should be noted that for supporting only a few (2–4) video windows, it may be more economical to implement several active counters rather than a window status table 166. Since in this mode there is no swapping of data, there is no need to differentiate between input and current ID signal 107 values. As a result, the current ID register 154 and ID status compare logic 155 can be eliminated leaving the input ID register 118 to serve as an indicator of which set of parameters to select. In this type of implementation the output of the counters are multiplexed using the input ID register value to select the desired counter while separate input control signals are generated by the control logic block 138 to selectively control the loading and incrementing of each counter (this is not shown).

While keeping separate active counters is a legitimate implementation for some environments the swapping mechanism offers an architecture which can support large numbers of video sources in an economical manner. The following description details the operation of a system employing a status swap mechanism.

E. Horizontal and Vertical Synchronization.

In step 206, the hardware device 101 supervises horizontal and vertical synchronization signals 146 and 148. In a raster scan format, Hsync 146 and Vsync 148 signals, provide a steering means for displaying pixels on the screen 302 on a row by row basis, from left to right, and from top to bottom. The Hsync 146 and Vsync 148 signals indicate exact boundaries for the window regions 304.

As shown in Table A below, four possible scenarios for Hsync 146 and Vsync 148 signals are defined.

TABLE A

| HORIZONTAL AND VERTICAL SYNCHRONIZATION | | |
|---|---|---|
| Vsync | Hsync | Go To |
| 0 | 0 | Step 208 |
| 0 | 1 | Step 209 |
| 1 | 0 | Step 210 |
| 1 | 1 | Step 210 |

In Table A, Vsync=0, Hsync=0, indicates that a pixel received by the data register 120 falls somewhere between the first and last pixel in a row within the window regions 304, and step 208 is performed. A Vsync=0, Hsync=1, indicates that a pixel received by the data register 120 is the last pixel of a row for a given window region 304, and step 209 is performed. A Vsync=1 Hsync =0 indicates the first pixel of a row within a window region 304 is received by the data register 120, and step 210 is performed. A Vsync=1, Hsync=1, indicates the first pixel for a window region 304 is received by the data register 120, and step 210 is performed.

The following discussion will be broken down into four sub-parts according to the raster scan format indicated by Table A.

1. The Start: Vsync=1, Hsync=0 or 1.

Vsync=1 indicates that the first pixel for a window region 304 designated by the input ID register 118 enters the data register 120. Referring to FIGS. 1 and 3, this indicates that the top most, left most pixel (390,50) of window C enters the data register 120. At the same time, an ownership ID value for window C enters the input ID register via data signal 107. The contents of input ID register 118 are now representative of window C. This condition is true independent of the Hsync signal 148 which may be either a 0 or a 1.

In step 210, the XO 114 and YO 116 parameter enters counter 136. The LD X' and LD Y' signals 157 from control logic block 138 indicate to counter 136 to load the XO 114 and YO 116 parameters from the initial window rectangle coordinate table 106. This is accomplished in step 210 by indexing the initial window rectangle coordinate table 106 with contents from the current ID register 154 via data signal 161. The contents act as a pointer to initial window rectangle coordinate table 106. As a result, the indexed contents from initial window rectangle coordinate table 106 are then loaded into pointer counter 136 (X' and Y' counters) with values XO 114 and YO 116.

In the following step 211, pixel counter 134 (pixel counters Px and Py) are loaded with horizontal and vertical boundary table values as determined by the previously loaded counter 136 (X' and Y' counters). In other words, counter 136 acts as a pointer to tables 108 and 110 via signals 169 and 173. The corresponding contents in horizontal and vertical boundary tables 108 and 110 are read to counter 134 via data flow arrow 175. LD Px and LD Py signals 158 from control logic block 138 indicate to counter 134 to load pixel values Px and Py. This establishes the horizontal and vertical boundary values for the current clip rectangle being displayed. It should be noted that at the end of this sequence the pixel counters Px and Py are equal to the horizontal and vertical boundary value (Xb, Yb) which are pointed to by the X' and Y' counters (counter 136).

2. Vsync=0, Hsync=0

As explained in Table A, a Vsync=0, Hsync=0, indicates that a pixel received by the data register 120 falls somewhere between the first and last pixel in a row within the window regions 304. Referring to FIG. 3, pixel (391,50) is the second pixel of the first row of window C. Therefore, referring to FIG. 2 according to step 206, the hardware device 101 will follow the middle path to step 208.

In step 208, the Px value of counter 134 is compared with the value indexed from the horizontal boundary table via data flow arrow 175. This value is indexed or pointed to by the X' component of counter 136. The comparison is performed by the boundary compare logic block 132. The comparison determines whether a pixel is crossing a divider 308 of a particular clip rectangle 310. If Px is less than Xb (where Xb stands for horizontal boundary of a particular clip rectangle) then the "NO" branch of decisional step 206 will be chosen. If Px is greater than or equal to Xb then a pixel has crossed a horizontal boundary for a particular clip rectangle 310 and the "YES" branch of decisional step 208 will be followed.

In the case of a "YES" from decisional block 208, the sequence proceeds to step 212. In step 212, the boundary compare logic block 132 sends an actuation signal 124 to control logic block 138 indicating a crossed horizontal boundary of a clip rectangle 3 10. Accordingly, control logic block 138 sends an INC X' signal 157 to counter 136 where INC X'=X'+1. Additionally, a no operation (NOP) Y' signal 157 is sent from control logic block 138 to counter 136 indicating that the Y' portion of counter 136 remains unchanged Y'=Y'. Thus, the incremented X' portion of counter 136 points to the next horizontal clip rectangle boundary value new value in the horizontal boundary table 108 via data flow arrow 173.

In the case of a "NO" from step 208 (the value of Px is less than the horizontal boundary indicating no boundary crossing) the sequence proceeds directly to step 213 bypassing step 212. In step 213, the Px value in counter 134 is incremented via control signal 158. This incremented Px value now points to the next pixel location in the current window 304 to be displayed. Py remains unchanged Py=Py.

3. Vsync=0, Hsync=1.

As explained above, a Vsync=0, Hsync=1, indicates that a pixel received by the data register 120 in the last pixel of a row for a given window region 304. Therefore, referring to FIG. 2, the right most branch marked "Vsync=0,Hsync=1" is chosen from decisional block 206.

In step 209, the boundary compare logic block 132, compares the Py value from counter 134 with the value from the vertical boundary table 110 pointed to by the Y' component of counter 136 (via data flow arrow 169). If the Py value is greater than or equal to the vertical boundary value of clip rectangle 310 (Yb), then the operation of the hardware device 101 will follow the "YES" branch of decisional step 209 and go to step 216. This indicates that a clip rectangle boundary crossing has occurred. If the Py value is not greater than or equal to the Yb value the operation of the hardware device 101 will follow the "NO" branch of step 209 and go to step 218. Assuming in a raster scan environment that Py is not greater than Yb, the "NO" branch will be described first.

As explained above, if Py is less than the vertical boundary Yb from the vertical boundary table 110, then no boundary crossing has occurred. In step 218, control logic block 138 sends a LD X' signal 157 to counter 136.

The XO value 114 from the initial rectangle coordinate table 106 is loaded into the counter 136 via data flow signal 167. Only the X' value in is loaded into the counter 136 from the initial window rectangle coordinate table 106 to step up the initial horizontal boundary value. The vertical boundary pointer Y' remains unchanged in this step since no boundary crossing was detected. The sequence then proceeds to step 219 described below.

A second possibility from step 209 is that a pixel will cross a clip rectangle 310 divider 308 in the vertical direction. In step 209, the boundary compare logic block 132 sends and actuation signal 124 to the control logic block 138. Referring to FIG. 2 this the "YES" branch form decisional step 209.

In step 216, the XO value 114 from the initial window rectangle coordinate block 106 is loaded into the counter 136 via data flow signal 167. This is in response to the LD X' signal 157 from the control logic block 138. The Y' value in counter 136 is incremented according the INC Y' signal 157 form the control logic block 138. The X' and Y' values from counter 136, via data flow arrows 173 and 169 respectively, act as pointers to horizontal and vertical boundary tables 108 and 110, respectively.

In the following step 219, the value indexed from the horizontal boundary table 108 is loaded into the Px portion of counter 134 via data flow arrow 175. This is in response to the LD Px signal 158 from control logic block 138. The Py value in counter 134 is incremented to the point to the next row in the current window 304. The INC Py signal 158 is from the control logic block 138.

F. Display Steps.

Determining whether to display data on the screen 302 involves a simple one step comparison of a stored value with an incoming pixel. The advantage over previous techniques in the present invention is less stored values are required. According to the present invention only a limited number of stored values need to be stored (not many more than the number of windows to be displayed). In the preferred embodiment comparisons take place every cycle (each time a pixel enters the hardware device 101). Comparisons can also occur at spaced intervals as may become apparent to those skilled in the art after reading further.

Referring to FIG. 2, blocks 222 and 224 represent the display steps. The display steps follow all three path branches from decisional block 206 and in particular follow blocks 211, 213 and 219. Regardless of which path is chosen the displays steps are operationally similar.

In step 222, the contents (X' and Y') of counter 136 act as a pointer to rectangle ID table 104 via data flow arrow 126. Accordingly, an owner ID value stored in table 104 during the initialization step 202 (explained above) indicates which source has priority over a particular clip rectangle 310. The stored owner ID value is indexed by signal 126. The indexed value or owner ID value is readout of the owner rectangle ID table 104 and sent to compare logic block 163. At the same time, the current owner ID value (A, B or C) is readout of the current ID register 154 via data flow arrow 161 to the owner ID compare block 163. The current ID value from the current ID register 154 is compared with the stored owner ID value from the rectangle ID table 104.

If the two IDs do not compare, then the incoming pixel in the data register 120 is obscured and discarded (referring to FIG. 2, this is the "NO" branch of step 222). In other words, the compare logic block 163 does not provide an actuation signal 177 to the control logic block 138. Therefore, the control logic block 138 does not send an enable signal 164 to the driver 122. At this point in the operation, the hardware device 101 will return to decisional block 203 and await for a data available signal 150 and start the process over again.

If the two IDs do compare, then in step 224 the control logic block 163 sends an actuation signal 177 to the control logic block 138. Referring to FIG. 3, this is the "YES" branch. The control logic block 138 will send an enable signal 164 to the driver 122. The pixel stored in data register 120 will now be driven to the frame buffer 172 via data flow arrow 171.

According to FIG. 2, the hardware device 101 repeats steps 203-222.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

Having thus described our invention, what we claim as new and desire to secure by Letters Patent is:

1. In a raster scan video display system for displaying non-obscured pixels in a multiple-media motion video environment possessing overlaid windows, apparatus comprising:

a horizontal memory table connected to a host for storing pixel values corresponding to vertically extended video window edges on a screen which intersect a horizontal axis of said screen;

a vertical memory table connected to said host for storing vertical pixel values corresponding to horizontally extended window edges which intersect a vertical axis of said screen, said horizontally and vertically extended video edges of said windows forming clip rectangles;

a rectangle identification (ID) memory table connected to said host for storing an ID value for said clip rectangles;

an initial window rectangle coordinate memory table, coupled to said host, for storing an initial coordinate value for a clip rectangle corresponding to each video window on said screen;

a first counter coupled to said horizontal and vertical memory tables for counting pixel coordinates starting from minimum horizontal and vertical pixel values received from said horizontal and vertical memory tables;

a second counter coupled to said initial window rectangle coordinate memory table for counting coordinates of said clip rectangles starting from said initial coordinate value stored in said initial rectangle coordinate table;

a first compare logic device coupled to said first counter for comparing an output of said first counter with said horizontal and vertical pixel values stored in said horizontal and vertical memory tables;

a second compare logic device coupled to said rectangle ID memory table for comparing said ID value stored in said rectangle ID memory table with an ID value received from a video source via registers coupled to said video source;

a control logic block coupled to said first compare logic device for generating a data display enable signal when said stored ID value and said received ID value compared in said second compare logic device are the same; and a data display driver coupled to an output of said control logic block for passing data to a video display buffer upon receipt from said control logic block of said data display enable signal.

2. An apparatus according to claim 1, further comprising a window status means coupled to said first counter and said second counter for storing away current values of said first and second counters upon an actuation signal indicating video data received by the apparatus is coming from a different video source.

3. An apparatus according to claim 2, wherein said window status means loads said first and second counters with current values of data stored in said window status means corresponding to said different video source upon said actuation signal.

4. An apparatus according to claim 2, further comprising an input ID register having an output connected to a current ID register and a comparator device, said input ID register having an input for receiving ID values from a video source, said current ID register having an output also connected to said comparator device, said comparator device for comparing ID values form said input ID register with ID values form said current ID register.

5. A system for displaying non-obscured pixels in a multiple-media motion video environment possessing overlaid windows on a screen, said video environment having video sources, each representative of a window, where positions of said windows are predetermined by a microprocessor and human interface, wherein said windows are plotted on said screen by way of a horizontal and vertical coordinate system indicating a horizontal and vertical pixel location for each window on said screen, said system comprising:

first memory means for storing horizontal boundary pixel values in increasing numerical order as derived from minimum and maximum horizontal window coordinates of each video window to be displayed on the screen;

second memory means for storing vertical boundary pixel values in increasing numerical order as derived from minimum and maximum vertical window coordinates of each window to be displayed on the screen, said horizontal and vertical window coordinates having intersecting to form clip rectangles;

third emory means for storing an identification (ID) value associated with each said clip rectangle designating ownership of said clip rectangle to one of the video windows to be displayed;

fourth memory means for storing coordinates identifying an initial clip rectangle for each of the displayed video windows;

first counter means coupled to said first and second memory means for counting pixel coordinates starting from said minimum and maximum horizontal and vertical coordinate values;

second counter means coupled to said fourth memory means for counting coordinate values of clip rectangles stored in said fourth memory means;

first compare logic means coupled to said first counter means for comparing an output of said first counter means with said horizontal and vertical boundary pixel values stored in said first and second memory means;

second compare logic means coupled to said third memory means for comparing said ID values stored in said third memory means with an ID value received from a video source of the video environment;

control means coupled to said second compare logic means for receiving vertical and horizontal synchronization signals from video sources and for generating a data display enable signal when said stored ID value and said received ID value compared in said second compare logic means are the same; and data display control driver means couple to an output of said control means for passing data to a video display buffer upon receipt from said control means of said display enable signal.

6. A system according to claim 5, further comprising a window status block coupled to said first and second counter means for storing away current values of said first and second counters upon an actuation signal indicating video data received by the system is coming from a different video source.

7. A system according to claim 5, wherein said first, second, third and fourth memory means are readable and writable memory devices.

8. A system according to claim 5, wherein said first, second, third and fourth memory means form one readable and writable memory device with separated tables of memory.

9. A system according to claim 5, wherein said first counter means comprises a first pixel counter for counting horizontal coordinate pixel values and a second pixel counter for counting vertical coordinate pixel values.

10. A system according to claim 5, wherein said second counter means comprises a first rectangle counter for counting clip rectangles in a horizontal coordinate direction and a second rectangle counter for counting clip rectangles in a vertical coordinate direction.

11. A system according to claim 5, wherein said first and second compare logic means are comparator devices.

12. A method for displaying non-obscured pixels in a multiple-media motion video environment possessing overlaid windows on a screen, where positions of said windows are predetermined by a microprocessor and human interface, wherein said windows are plotted on said screen by way of a horizontal and vertical coordinate system indicating a horizontal and vertical pixel location for each window on said screen, said method comprising the steps of:

(1) encoding data comprising the sub-steps of:

(a) extending window edges in vertical and horizontal directions corresponding to the horizontal and vertical coordinate system on the screen to form a multiple of clip rectangles;

(b) assigning horizontal and vertical pixel values at locations where said extended window edges intersect the horizontal and vertical coordinate system;

(c) assigning an ownership identification (ID) value for each said clip rectangle according to window priority;

(d) using one label of one clip rectangle to identify a window; and (e) storing said pixel values, said ownership ID values, and said one label of said clip rectangle mentioned in sub-steps b-d;

(2) decoding the encoded data of step (1) comprising the sub-steps of:

(a) tracking incoming video data and associated ID data with said video data, (b) tracking vertical and horizontal synchronization signals from a video source indicating locations of said incoming video data for display on the screen;

(3) determining whether said associated ID data corresponding to said incoming video data compares to said stored ownership ID values of said encoding step; and (4) displaying said incoming video data, if said associated ID data compares to said stored ownership ID values.

13. In a raster scan video display system having video sources for displaying non-obscured pixels in a multiple-media motion video environment possessing overlaid windows, apparatus comprising:

(a) a memory device comprising:

a horizontal memory table connected to a host for storing pixel values corresponding to vertically extended video window edges on a screen which intersect a horizontal axis of said screen;

a vertical memory table connected to said host for storing vertical pixel values corresponding to horizontally extended window edges which intersect a vertical axis of said screen, said horizontally and vertically extended video edges of said windows forming clip rectangles;

a rectangle identification (ID) memory table connected to said host for storing an ID value for said clip rectangles;

an initial window rectangle coordinate memory table for storing an initial coordinate value for one clip rectangle corresponding to each window video display on said screen;

(b) a register and control portion of the apparatus having elements connected to said memory device and to the video sources, said register and control portion comprising:

a data register connected to the video sources for receiving and latching video display data, said data register having a data register output;

an input ID register also connected to the video sources for receiving ID data corresponding to said display data indicative of which video source sent said display data; said input ID register having an output connected to said initial window rectangle coordinate table for pointing to said initial coordinate value which is read out of said initial window rectangle coordinate value table;

a first counter connected to said initial window rectangle coordinate value table for receiving said initial window coordinate value, said first counter having a first counter output connected to said vertical and horizontal boundary tables and to said rectangle Id table, for using said initial window coordinate value as an index for indexing said values of said vertical and horizontal boundary tables and said rectangle ID table;

a second counter connected to said vertical and horizontal boundary tables for receiving horizontal and vertical pixel values indexed from said vertical and horizontal boundary tables;

a control logic block connected to said video source for receiving Hsync and Vsync signals, said control logic block also connected to said first counter and said second counter for loading and incrementing said first and second counters;

a boundary compare logic block connected to said second counter and said vertical and horizontal boundary tables for comparing contents of said second counter with said horizontal and vertical pixel values indexed from said horizontal and vertical boundary tables, said boundary compare logic also connected to indicate to said control logic block when to increment or load said second counter;

an owner ID compare logic block connected to said rectangle ID table and said input ID register for comparing said stored ID value of said clip rectangles with said ID data; and a driver connected to said ID compare logic block for driving video display data when said stored ID value of said clip rectangles are the same as said ID data.

* * * * *